United States Patent [19]

Graydon et al.

[11] Patent Number: 4,786,375

[45] Date of Patent: Nov. 22, 1988

[54] MANUFACTURE OF SELF SUPPORTING MEMBERS OF COPPER CONTAINING PHOSPHORUS

[75] Inventors: John W. Graydon, Toronto; Donald W. Kirk, Ontario, both of Canada

[73] Assignee: Falconbridge Limited, Toronto, Canada

[21] Appl. No.: 75,896

[22] Filed: Jul. 21, 1987

[30] Foreign Application Priority Data

Jul. 25, 1986 [CA] Canada ..... 514722

[51] Int. Cl.[4] ..... C25D 1/12; C25D 3/38; C25D 5/50

[52] U.S. Cl. ..... 204/3; 204/37.1; 204/44; 204/52.1; 204/123

[58] Field of Search ..... 204/52.1, 52.5, 44, 204/37.1, 16, 123, 3; 420/469

[56] References Cited

U.S. PATENT DOCUMENTS 3,672,970 6/1972 Tomaszewski ..... 204/52.1

FOREIGN PATENT DOCUMENTS 454939 3/1949 Canada ..... 420/469
1055738 6/1979 Canada .
3121826 1/1983 Fed. Rep. of Germany .
2043883 2/1971 France .

OTHER PUBLICATIONS

The American Brass Co., Publication B-32, (1959).
Stanislaw Nowak et al., Rudy i Metale Nieżelazne, R. 13, No. 12, pp. 649-651, 1968.
Chemical Abstracts vol. 81, 1926, p. 326, 9162j, abstract of French patent appln 2187413, David. F. et al.
Chemical Abstracts vol. 98, 1983, p. 337, 9897972c, abstract of German pat. appln 3121826, Landes, K. et al.

*Primary Examiner*—G. L. Kaplan
*Attorney, Agent, or Firm*—Ridout & Maybee

[57] ABSTRACT

Self supporting members of copper containing phosphorus, for example bulk copper anodes or plates, for use as consumable anodes for copper electrodeposition or for melting for alloy production are manufactured by electrodeposition from an electrolyte containing copper ions and a suspension of phosphorus bearing particles having a phosphorus concentration of up to about 5 grams per liter.

14 Claims, 4 Drawing Sheets

MANUFACTURE OF SELF SUPPORTING MEMBERS OF COPPER CONTAINING PHOSPHORUS

This invention relates to manufacture of self-supporting members, for example bulk anodes or plates, of phosphorus-bearing copper.

Copper is frequently used as a coating either to protect a metal body from corrosion, or for decorative purposes, or to provide a layer for other metals such as nickel to be deposited on. Such copper coatings are often obtained by electrodeposition from a copper bath obtained by dissolving copper anodically. It is important that the copper dissolve evenly and easily without forming particles of undissolved copper which become inert and are lost as sludge in the residue of the bath. Such even dissolution is ensured by the presence of certain additives such as phosphorus in the copper. The phosphorus needs to be present at relatively low concentration levels and distributed evenly throughout the copper. During dissolution, the phosphorus promotes the formation of a thin black adherent film which enhances the uniform dissolution of the copper. The phosphorus does not migrate into the electrolyte except in the form of a barely measurable content of soluble phosphate ion. High concentrations of phosphorus in the deposited copper, or uneven concentrations, however, have adverse effects on the dissolution of the copper metal.

Processes are known for forming self-supporting consumable copper anodes having a uniform distribution of phosphorus by casting them from a melt produced by melting copper and adding phosphorus or a suitable phosphorus compound to the melt with agitation while ensuring that neither of the components oxidize, and no impurities are picked up. Such melting and casting processes however, considerably increase the production cost of the copper product. Furthermore, for uniform low phosphorus content requirements, prolonged mixing and stirring periods are essential, and this can lead to losses by oxidation.

To reduce the cost of producing copper with the required additive, attempts have been made to codeposit phosphorus-containing copper from an electrolyte of copper ions and water soluble phosphorus-containing anions but these have been unsuccessful.

In a process described in German patent application No. DE3121826A1, published Jan. 13, 1983 in the name Robert Bosch GmbH, a thin layer of phosphorus-bearing copper is electrodeposited on a copper-workpiece from a copper electrolyte slurried with 10 to 400 grams per liter of phosphorus. The deposited composite thin layer comprises copper and phosphorus in proportions corresponding to the eutectic or close to eutectic composition and thus has a reduced melting point as compared with pure copper, and serves the purpose of facilitating the making of connections to the workpiece by brazing or hard soldering. This phosphorus-bearing copper layer can be between 5 and 500 μm. Such deposited thin layers are, of course, not self-supporting members.

French Patent Publication No. 2,043,883 dated Feb. 8, 1971 in the name David et al., describes a method for obtaining a phosphorus containing copper article, by covering a copper article with finely ground copper phosphide or a suitable finely ground phosphorus salt, then subjecting the coated article to prolonged heating in a closed container in order to diffuse phosphorus into the body of the copper article. It is inevitable that the phosphorus distribution in the copper article of this process will be uneven, and that prolonged heating periods are required to achieve the desired results.

In a process for making sintered phosphorus-bearing copper, taught in Canadian Pat. No. 1,055,738 in the name INCO Ltd., dated June 5, 1979, fine copper powder is slurried with orthophosphoric acid, subsequently dried, compacted or briquetted, and heated in a reducing atmosphere in two stages. This is yet another process utilizing heat treatment, subsequent to a separate mixing operation step, to obtain a copper-phosphorus alloy.

A method has now been found whereby self-supporting members, for example bulk anodes or plates, comprising copper containing phosphorus in uniform distribution through the copper can be obtained. The proces comprises electrodepositing from a copper electrolyte containing a suspension of particles of phosphorus or of a phosphorus bearing compound in an amount of up to about 5 grams of phosphorus per liter, to form an electrodeposited member of desired thickness. With these concentrations of phosphorus in the electrolyte, there can be obtained members having contents of phosphorus which are highly advantageous when the members are used as consumable anodes in electrodeposition, or when the members are used for other purposes. The electrodeposition may be carried out in a conventional electrolytic cell.

Without wishing to be bound by any theory, it is suggested that, during the process of electrodeposition, the phosphorus particles with copper ions absorbed on their surface will migrate to the cathode, and are subsequently codeposited with the copper onto the cathode. The exact mechanism is not known, but apparently the phosphorus-containing particles are not dissolved in the electrolyte before they are codeposited with copper. Whatever is the depositing mechanism, the resulting electrodeposited copper product shows uniform phosphorus distribution in the form of very small inclusions which are visible under the microscope. In the event that the electrodeposited member is to be used as a consumable anode, we have found it necessary to homogenize the member, so as to bring the phosphorus into solid solution in the copper, before use.

The application of this new method to obtaining phosphorus containing electrodeposited copper, is shown by the accompanying drawing Figures and by a description of a preferred embodiment of the invention, and further illustrated by the Examples.

The present invention utilizes phosphorus bearing particles which may be essentially of elemental phosphorus or of a suitable finely divided compound of phosphorus, and which are added to an electrolyte to form a fine suspension or a slurry.

Figure 1:
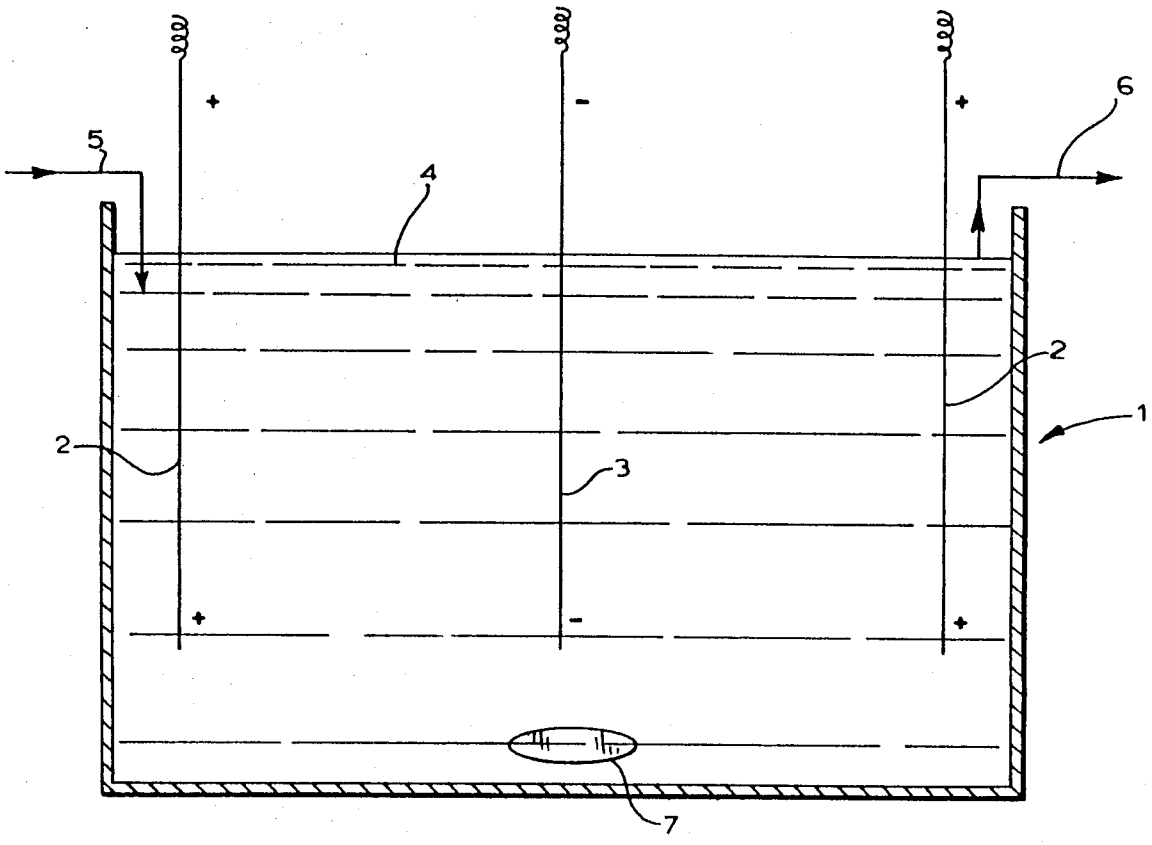
FIG. 1 shows a schematic diagram of one form of an electrodepositing cell for obtaining phosphorus bearing copper plates.

Referring to the drawings, the process of the invention may be carried out in a conventional electrolytic cell 1, such as normally used for electrodepositing copper by either electrowinning or electrorefining, and as schematically shown in FIG. 1. FIG. 1 shows two anodes 2 and one cathode 3, but it should be understood that in commercial applications an electrolytic cell normally contains several anodes and several cathodes. When the codeposition is an electrowinning process, the anodes 2 are made of a conventional inert material, and, where the codeposition is an electrorefining process, may be consumable copper anodes. The electrolyte 4 may be a conventional copper ion bearing solution of any convenient copper salt, for example copper sulphate, at the pH and temperature conventionally used. The electrolyte forms the liquid phase of a slurry or a suspension of the phosphorus bearing solid particles. The suspension may be fed continuously through a conduit 5 and depleted or spent electrolyte may be removed continuously through a conduit 6. The applicants have found that for ease of maintaining an even suspension density of particles during the process of electrodeposition, a convenient particle size is less than 100 μm, with the bulk of particles being in the range of less than 50 μm. The predominance of very fine submicroscopic particle sizes is to be avoided, because such particles show increased rate of oxidation. The lower limits in particle size are, however, dictated by convenience only. The electrolyte containing the phosphorus bearing particles may be stirred if necessary to maintain the particles in suspension, for example using a magnetic stirrer 7. The applicants have found that the concentration of phosphorous in the electrodeposit varies with the concentration or dispersion loading of the phosphorous in the electrolyte and that dispersion loadings in excess of about 5 gram phosphorus per liter produce undesirably high phosphorus concentrations in the copper plate obtained by electrodeposition. More typically, the dispersion loading will be about 0.01 to about 2 grams of phosphorus per liter.

Desirably, for use as a consumable anode, the electrodeposit contains from about 0.01 to about 0.1 weight percent phosphorus and the balance essentially copper. At contents of phosphorous below about 0.01 percent, little improvement in dissolution efficiency tends to be observed, while at contents much in excess of about 0.1 percent, the anode tends to form during dissolution an excessively thick film that sloughs off into the solutions, thus leading to problems because of excessive residue of the film in the electrodeposition bath, and tends to produce polarizing effects leading to power inefficiencies. Further, the film tends to slow down dissolution of the anode, thus slowing deposition at the cathode. Preferably, the content of phosphorus in the electrodeposit is from about 0.03 to about 0.08, still more preferably about 0.04 to about 0.07 weight percent and the balance essentially copper.

The cathode may be any conventional mother plate used in copper electrowinning or electrorefining. In one form, initially a strippable cathode e.g. of stainless steel is employed. Once a self-supporting thickness of phosphorus-containing copper has been deposited, e.g. of 1 or 2 mm thickness, it is stripped off and is used as the cathode for remainder of the electrodeposition process. In another form, copper is grown to full thickness before stripping it from a permanent cathode.

The current densities can be those conventionally used in obtaining copper electroplates, and the electrolyte may or may not contain conventional levelling agents, for example bone glue or AVITONE (trade mark), used in amount of about 10 mg per liter. The electrodeposit of phosphorus-bearing copper will typically be at least 2 mm, more usually about 0.5 cm to 2 cm thick.

The phosphorus bearing particles may be of elemental phosphorus or of metal phosphide. The elemental phosphorous or metal phosphide employed should, of course, be sufficiently stable to be capable of forming a suspension in the electrolyte containing dissolved copper ions. Red phosphorus is the preferred form of elemental phosphorus for use in the present process. The applicants have found that good and controlled phosphorus codeposition in copper can also be obtained using a suspension of metal phosphide particles. Preferably the metal phosphide is copper phosphide, but other metal phosphides, e.g. nickel phosphide, may be used where small contents of nickel or other non-copper metal in the deposited copper are acceptable.

In another form of the present method, a phosphorus containing gas, such as for example phosphine, is absorbed in the electrolyte to produce phosphorus bearing particles of, for example, copper phosphide in situ, to be codeposited at the cathode.

Employing the above-described methods, self-supporting members of copper containing predetermined or readily ascertainable concentrations of phosphorus can be obtained. Such members are useful for melting for alloy production.

As discussed above, the phosphorus is dispersed in the form of inclusions visible under the microscope in the electrodeposited copper. When the self supporting members are to be employed as consumable anodes, the applicants have found that in order to avoid problems of non-uniformity of corrosion of the anode, production of small particles in the electrolyte solution which can cause roughness on the electroplate, and lack of formation of a film of the desired quality on the anode copper, it is necessary to homogenize the members in order to bring the phosphorus into solution in the copper. Such homogenization may be conducted by cold working or hot working the members but is conveniently performed by subjecting the members to an homogenizing anneal. Such anneal may be performed at temperatures above 300° C. and below the melting point of the copper. The most convenient annealing temperature range is 600° to 900° C. and the deposits are held at this temperature for an appropriate period, which, depending on the temperature employed, may range from 5 minutes to 6 hours, in an inert atmosphere.

The following examples will show the applications of the present invention to obtaining copper electrodeposits, as well as the improvements in the properties of the product obtained.

EXAMPLE 1

Copper was deposited from copper ion containing solution onto the cathode of an electrolytic cell, schematically depicted in FIG. 1. The electrolyte was an acid copper sulphate solution, containing 160 grams per liter copper sulphate and 75 grams per liter sulphuric acid. A fine powder of red phosphorus was added to the electrolyte to achieve a loading value of 0.29 gram per liter. The red phosphorus had a maximum particle size below 100 82 m, with the bulk of the particles being less than 40 μm in size. The anode was a platinum foil, but any commercially available inert anode could be used.

A cleaned stainless steel plate served as cathode. The cell was fitted with a magnetic stirrer in order to keep the red phosphorus particles in suspension. The suspension was allowed to stabilize before electroplating was started. The bath temperature was kept at 25.5° C.±1° C. The duration of the copper electrodeposition was 420 minutes, with a current density of 4 A/dm$^2$. The weight of copper deposited in this time period was 6.43 grams and its phosphorus content was 0.185 wt. %.

It will be clear to those familiar with electrodeposition, that this example reproduced conditions for electrowinning copper. The process of this invention could be conducted equally well for the purposes of electrorefining, if the inert anode were to be replaced by unrefined copper, which would then go into solution while refined copper is deposited at the cathode.

EXAMPLE 2

Figure 2:
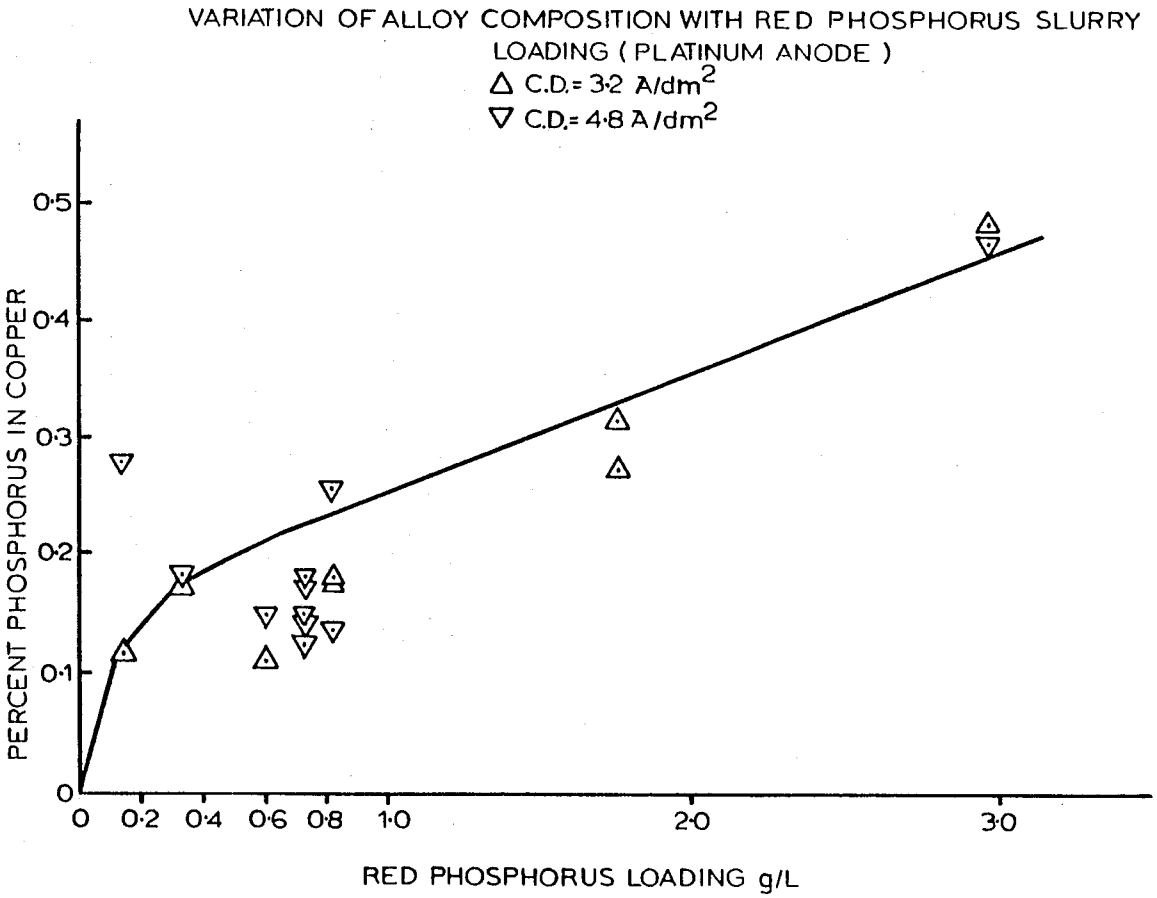
FIG. 2 is a graph obtained by plotting the phosphorus content in the copper plate against the red phosphorus content of the suspension.

The method of Example 1 was repeated using in one series of depositions a current density of 3.2 A/dm$^2$ and 4.8 A/dm$^2$ in a further series, and employing various loadings of red phosphorus in the electrolyte. The phosphorus content in the electrodeposited copper was plotted against the red phosphorus loading of the electrolyte and this is shown in FIG. 2.

EXAMPLE 3

The copper deposit of this Example was obtained under conditions the same as those of Example 1, except the red phosphorus was replaced by copper phosphide ($Cu_3P$) in the suspension. The electrolyte was slurried with fine particles of copper phosphide, of particle size predominantly 0.5 to 20 μm with some few particles up to 50 μm, at a loading value of 2.0 grams per liter, equivalent to 0.28 gram phosphorus per liter. The phosphorus level in the copper deposit obtained was 0.115 wt. %.

EXAMPLE 4

Figure 3:
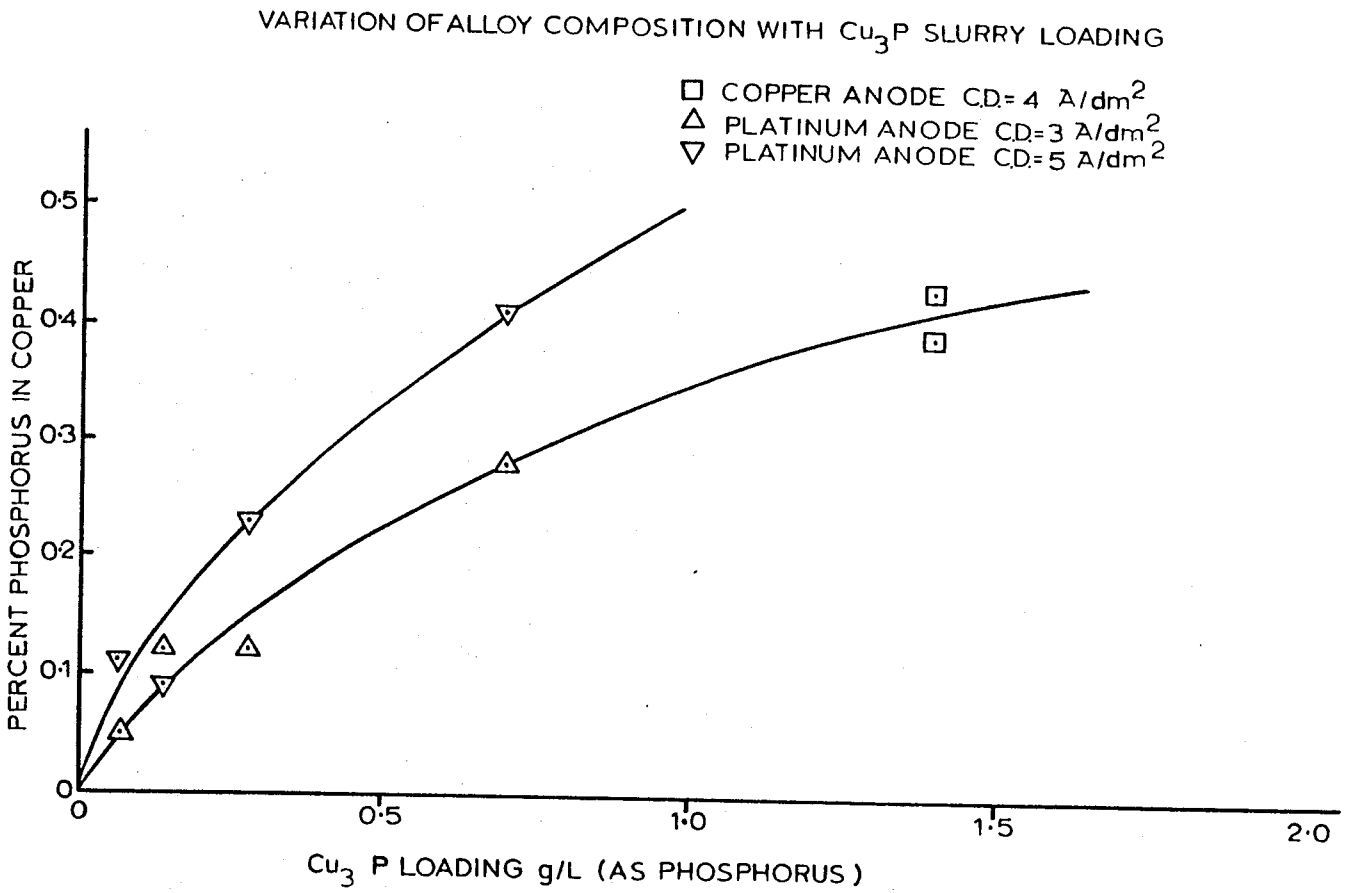
FIG. 3 shows a graph of plotting the phosphorus content in the copper plate against the copper phosphide content of the suspension.

A series of experiments were run utilizing copper phosphide suspension in acid copper sulphate containing electrolytes. The current densities used at the cathode varied between 3 A/dm$^2$ and 5 A/dm$^2$. In some experiments a copper anode was used to simulate conditions of electrorefining. The weight percent phosphorus in the copper deposited was plotted against the phosphorus content in the copper phosphide suspension and is shown in FIG. 3.

The above examples indicate that the phosphorus content in the electrodeposited copper can be well controlled, and the conditions for obtaining phosphorus-bearing copper deposits at the desired level when conducted according to this invention are well reproducible.

EXAMPLE 5

Copper was electrodeposited in a cell as schematically shown in FIG. 1 and having an inert anode, from a copper ion containing electrolyte. The electrolyte was prepared by mixing 100 ml plating solution containing 250 grams per liter $CuSO_4.5H_2O$ and 75 grams per liter $H_2SO_4$ with 100 ml of an aqueous phosphine containing-solution containing 80 mg $PH_3$ per liter producing a suspension of copper phosphide particles. Copper was plated from the suspension onto a cathode at a current density of 1 A/dm$^2$ at 25° C., to produce a 0.30 mm thick phosphorus bearing copper plate. The copper plate had 0.08% by weight phosphorus dispersed in it.

This Example shows that phosphorus-bearing copper can be obtained by electrodepositing from a suspension of copper phosphide particles obtained by means of a phosphorus containing gas.

EXAMPLE 6

Figure 4:
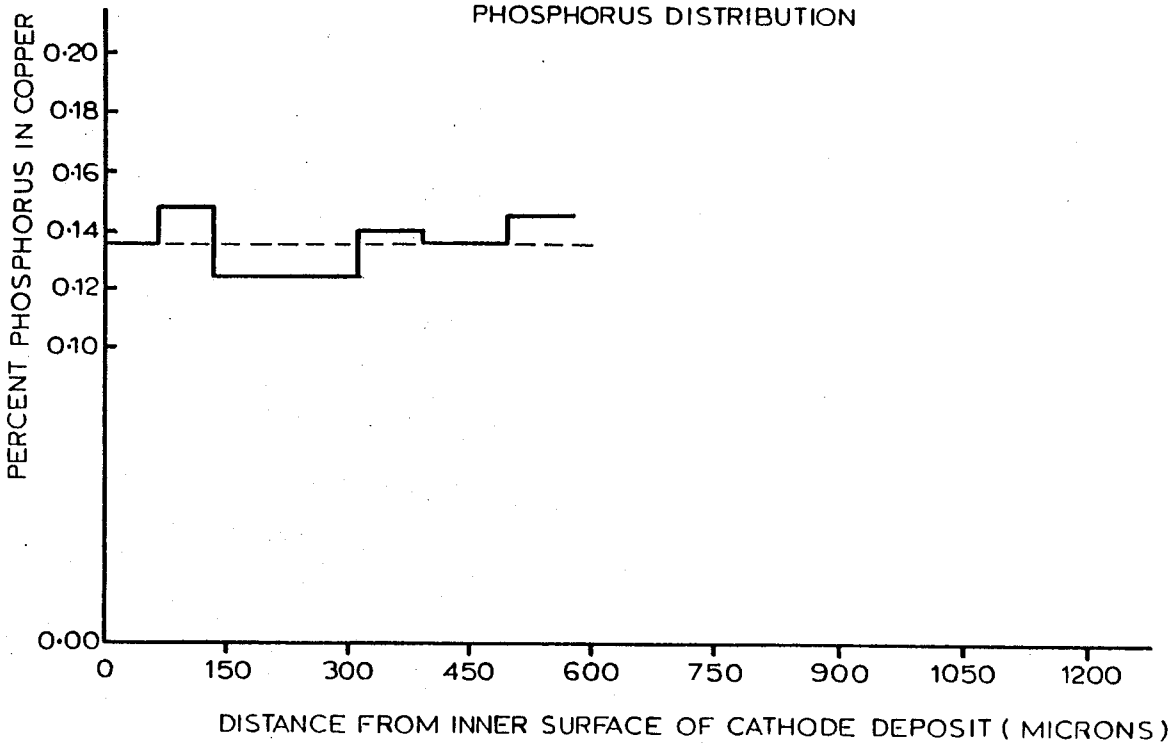
FIG. 4 shows a phosphorus concentration profile measured within an electrodeposited copper foil.

The phosphorus distribution profile was determined in a thick piece of copper obtained by making an electrodeposit according to Example 1 above, stripping the electrodeposit from the cathode, and analyzing layers dissolved in increments from the inner side of the deposit for phosphorus content. The percent phosphorus content in the layers dissolved as a function of depth in the copper deposit is shown in FIG. 4. There is substantially no deviation from the average phosphorus content as the depth of dissolution is increased, showing uniform distribution of phosphorus within the electrodeposited copper.

EXAMPLE 7

Examples of copper plate were tested for anodic dissolution efficiency. The copper samples had the following history of manufacture.

1. Unphosphorized oxygen free high conductivity copper (O.F.H.C.),
2. Phosphorized copper produced by casting,
3. Phosphorus-containing electrodeposited copper obtained according to the present invention, and subsequently annealed at 820° C., for 4 hours.
4. Phosphorus-containing electrodeposited copper obtained according to the present invention but *not* subjected to homogenizing heat treatment.

Each sample had a 4.9 cm$^2$ polished surface, and the samples were suspended in an electrolyte containing 220 grams copper sulphate, 50 grams sulphuric acid and 0.09 grams sodium chloride per liter. The pieces were coated with epoxy resin, apart from the polished surfaces. The anodic dissolution was carried out for 22 hours at a current density of 4 A/dm$^2$. Phosphorized anodes of samples 2 and 3 developed a thin black adherent surface film after one hour that persisted throughout the run and corroded uniformly and evenly, while the O.F.H.C. sample (No. 1) formed no film and corroded completely irregularly. Samples 2 and 3 produced substantially less anodic residue in the plating solution than the O.F.H.C. copper (sample no. 1). The cathodic plate produced by the anodic dissolution of phosphorus-containing copper (no. 3) was considerably smoother, and more free of nodular growth, than that obtained with the O.F.H.C. The untreated sample no. 4 did not develop the desired thin black adherent film and it corroded unevenly with marked pitting. There was more than twice as much anodic debris produced in the plating solution and the cathode plate was much rougher and more nodular as compared with sample No. 3. The efficiency of cathodic deposition, based on the anodic weight loss was 99.0% for O.F.H.C. (no. 1), 99.71% for the cast phosphorus copper (No. 2), 100% for the electrolytic phosphorus-bearing copper (No. 3), and 96.95% for the untreated sample (No. 4). The latter result was much inferior to that obtained with sample no. 3.

We claim:

1. A method for manufacturing a self-supporting member comprising copper containing phosphorus, comprising:

providing an electrolyte containing dissolved copper ions and phosphorus bearing particles selected from elemental phosphorus and metal phosphide suspended therein, and having a phosphorus loading of up to about 5 grams per liter;

providing an electrolytic cell having at least one anode and at least one cathode immersed in said electrolyte;

and passing electric current between said anode and cathode for a time sufficient to deposit a desired thickness of copper containing phosphorus onto said cathode.

2. A method according to claim 1 wherein the phosphorus loading is about 0.01 to about 2 grams per liter,

3. A method according to claim 1 wherein the phosphorus-bearing copper deposit is homogenized subsequent to electrodeposition to dissolve phosphorus particles in the copper.

4. A method according to claim 3 wherein the deposit is homogenized by subjecting it to an homogenizing anneal at temperatures between 400° C. and the melting temperature of the metal.

5. A method according to claim 1 wherein said cathode comprises a member comprising copper containing phosphorus.

6. A method as recited in claim 1 wherein the phosphorus bearing particles are elemental, red phosphorus.

7. A method according to claim 6 wherein the particle size of the phosphorus particles is less than about 100 μm.

8. A method according to claim 6 wherein the red phosphorus loading is less than about 1 gram per liter.

9. A method as recited in claim 1 wherein the phosphorus bearing particles are metal phosphide.

10. A method according to claim 9 wherein the particle size of the phosphorus bearing particles is less than about 100 μm.

11. A method according to claim 9 wherein the metal phosphide comprises copper phosphide at a loading in the suspension of less than about 10 grams per liter.

12. A method for obtaining electrodeposited phosphorus bearing copper as described in claim 1 wherein the electrolyte solution contains dissolved copper salts.

13. A method for obtaining electrodeposited phosphorus bearing copper as described in claim 1 wherein the copper in the electrolyte solution is present as copper sulphate.

14. A method according to claim 1 wherein a phosphorus containing gas is reacted with the copper ion-containing electrolyte solution to form said phosphorus bearing particles.

* * * * *